US006632146B1

(12) United States Patent
Halko et al.

(10) Patent No.: US 6,632,146 B1
(45) Date of Patent: Oct. 14, 2003

(54) MULTIPLE THREAD GOLF BALL

(75) Inventors: Roman D. Halko, Natick, MA (US); Laurent Bissonnette, Portsmouth, RI (US); Emanual Vieira, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 167 days.

(21) Appl. No.: 09/610,606

(22) Filed: Jul. 5, 2000

(51) Int. Cl.[7] ..... A63B 37/06
(52) U.S. Cl. ..... 473/357
(58) Field of Search ..... 473/356–366

(56) References Cited

U.S. PATENT DOCUMENTS

| | | | | |
|---|---|---|---|---|
| 2,004,167 A | * | 6/1935 | Madge | 473/356 |
| 3,130,974 A | * | 4/1964 | Muccino | 473/356 |
| 3,134,598 A | * | 5/1964 | Muccino | 473/356 |
| 3,201,298 A | | 8/1965 | Baker et al. | |
| 3,347,479 A | | 10/1967 | Livingston | |
| 3,933,321 A | | 1/1976 | Kawauchi et al. | 242/43 R |
| 4,029,266 A | | 6/1977 | Mori et al. | 242/20 |
| 4,473,229 A | | 9/1984 | Kloppenburg et al. | 273/225 |
| 4,846,910 A | | 7/1989 | Brown | 156/170 |
| 5,685,785 A | | 11/1997 | Kakiuchi et al. | 473/354 |
| 5,713,801 A | | 2/1998 | Aoyama | 473/354 |
| 5,755,628 A | | 5/1998 | Kakiuchi et al. | 473/354 |
| 5,816,939 A | | 10/1998 | Hamada et al. | 473/357 |
| 6,030,296 A | | 2/2000 | Morgan et al. | 473/361 |
| 6,350,815 B1 | * | 2/2002 | Sullivan et al. | 525/196 |

FOREIGN PATENT DOCUMENTS

| | | |
|---|---|---|
| AU | A-16547/97 | 2/1997 |
| AU | A-16548/97 | 2/1997 |

* cited by examiner

*Primary Examiner*—Mark S. Graham
*Assistant Examiner*—Raeann Gorden
(74) *Attorney, Agent, or Firm*—Swidler Berlin Shereff Friedman, LLP

(57) ABSTRACT

The present invention is directed towards a golf ball and a method of making a golf ball which comprises a center, at least one cover layer, and at least one layer of windings between the center and the cover having at least two threads. Preferably, the threads of the present invention have different physical or chemical properties and are wound onto the center of the golf ball simultaneously. The threads may be wound with varying tensions or angles. The wound layer of the present invention may be applied to golf balls with liquid or solid centers to achieve desired golf ball characteristics.

31 Claims, 5 Drawing Sheets

MULTIPLE THREAD GOLF BALL

FIELD OF THE INVENTION

This invention relates generally to golf balls, and more particularly to wound golf balls made with multiple threads.

BACKGROUND OF THE INVENTION

Conventional golf balls can be divided into two general groups: solid balls or wound balls. The difference in play characteristics resulting from these different types of construction can be quite significant. Balls having a solid construction are generally most popular with the average recreational golfer because they provide a very durable ball while also providing maximum distance. Solid balls are generally made with a solid core, usually made of a cross linked rubber, enclosed by a cover material. Typically the solid core is made of polybutadiene which is chemically crosslinked with zinc diacrylate and/or similar crosslinking agents. In addition to one-piece solid cores, solid cores may also contain a number of outer layers, such as in a dual core golf ball. The cover is generally an ionomeric material, such as SURLYN®, which is a tradename for a family of ionomer resins produced by E. I. DuPont de Nemours & Co. of Wilmington, Del. Covers are typically a single layer but may also include one or more layers, such as in a double cover having an inner and outer cover layer.

The combination of the solid core and ionomeric cover materials provide a ball that is very durable and abrasion resistant. Further, such a combination imparts a high initial velocity to the ball which results in increased distance. Because these materials are very rigid, however, solid balls can have a hard "feel" when struck with a club. Likewise, due to their construction, these balls have a relatively low spin rate which provides greater distance.

At the present time, wound golf balls generally are the preferred ball for the more advanced player due to the spin and feel characteristics afforded by such a construction. Wound balls typically have either a spherical solid rubber or liquid center core, around which many yards of a tensioned elastomeric thread are wound. The wound core is then covered with a durable cover material, such as SURLYN® or similar material, or a softer cover material, such as balata or polyurethane. Wound balls are generally softer and provide more spin, which enable a skilled golfer to have more control over the ball's flight and position. Particularly, with approach shots onto the green, the high spin rate of soft, wound balls enable the golfer to stop the ball very near its landing position.

Regardless of the form of the ball, players generally seek a golf ball that maximizes total game performance. Therefore, in an effort to meet the demands of the marketplace, manufacturers strive to produce golf balls with a wide variety of performance characteristics to meet the players individual requirements. Thus, golf ball manufacturers are continually searching for new ways in which to provide golf balls that deliver the maximum performance for golfers of all skill levels.

To make wound golf balls, manufacturers use winding machines to stretch the elastic threads to various degrees of elongation during the winding process without subjecting the threads to unnecessary incidents of breakage. Generally, as the elongation and the winding tension increases, the compression and initial velocity of the ball increases. Thus, a more resilient wound ball is produced, which is desirable.

For golf balls, the thread is typically formed by a calendar and slitting method rather than an extrusion method. The calendered thread has a rectangular cross-section, while extruded thread generally has a circular cross-section. Extruded thread was not previously used in golf ball applications, because it has not exhibited the physical properties necessary for proper performance of golf balls. An example of an extruded thread that is not used in golf balls is disclosed in U.S. Pat. No. 5,679,196 issued to Wilhelm et al. This patent discloses a thread formed of a mixture that has more than 50% natural rubber.

A number of different windings have been disclosed for use in golf balls. U.S. Pat. No. 4,473,229 to Kloppenburg et al. discloses a golf ball having a core formed of graphite fibers and windings made of graphite filaments and resins. Yarns are made with the graphite filaments and resins, and as many as four or more yarns are combined to form a final yarn used for winding. U.S. Pat. No. 5,713,801 to Aoyama discloses use of a layer of high tensile elastic modulus fibers wound about the core. The fibers have a tensile elastic modulus of at least 10,000 psi. Also, U.S. Pat. No. 5,816,939 to Hamada et al. discloses a rubber thread for winding with a tensile strength retention of $\geqq 70\%$, a hysteresis loss of no more than 50%, and an elongation of 900–1400%.

Prior art wound golf balls and cores typically use polyisoprene rubber thread. The polyisoprene thread is wound onto the cores at elongations between 500–1000%. The amount of thread required for a golf ball core is dependent on the elastic modulus of the thread in the elongated state. Elongated polyisoprene thread generally has an elastic modulus between 10,000 and 20,000 psi. Further, the properties, in particular resilience, of the wound ball or core are dependent on how well the thread packs during winding. The dimensions of the thread control the packing density. Present art polyisoprene threads are typically 1/16-inches wide by 0.02-inches thick, measured prior to winding. However, present art polyisoprene thread is commonly produced in thicknesses between 0.014 inches and 0.024 inches.

There are some drawbacks to the conventional single-ply threads used in golf balls. The single-ply occasionally contains weak points. As a result, manufacturers of wound balls do not wind using the maximum tension or stretch the thread to the maximum elongation, because to do so would cause an excessive amount of breakage during winding. When a thread breaks during manufacturing, an operator must restart the operation. This decreases production, and is thus undesirable. The use of two-ply threads in golf balls reduces but does not eliminate this problem.

SUMMARY OF THE INVENTION

The present invention is directed to wound single and multilayer golf ball cores and golf balls. Generally, the prior art has been directed to making golf balls and cores using single-ply or two-ply polyisoprene thread. The resilience and other properties of the golf ball are dependent on how well the thread packs during winding. The present invention is directed to a golf ball that has multiple threads wound on the golf ball center simultaneously. More preferably, the present invention is directed to a golf ball that has multiple threads wound about the center simultaneously where the threads have different properties.

Preferably, the golf ball of the present invention provides a wound core of a golf ball with unique thread construction and performance characteristics through the use of at least two threads having different chemical, physical, thermal or mechanical properties. Conventional calendering and slitting, melt spinning, wet spinning, dry spinning, and polymerization spinning may be used to produce the threads. Most preferably, each of the threads wound onto the center are different from each other in some characteristic such as cross-section, composition, elongated state, physical property, or mechanical properties. Mechanical properties are, for example, resiliency, elastic modulus, and density.

The threads may be comprised of a suitable material including polyisoprene. Suitable polymers include polyether urea, such as LYCRA®, polyester urea, polyester block copolymers such as HYTREL®, isotactic-poly(propylene), polyethylene, polyamide, poly(oxymethylene), polyketon, poly(ethylene terephthalate) such as DACRON®, poly(p-phenylene terephthalamide) such as KEVLAR(®, poly (acrylonitrile) such as ORLON®, diaminodicyclohexylmethane and dodecanedicarboxylic acid such as QUINA®. LYCRA®, HYTREL®, DACRON®, KEVLAR®, ORLON®, and QUINA® are available from E. I. DuPont de Nemours & Co. of Wilmington, Del. Glass fiber and, for example, S-GLASS® from Corning Corporation can be used.

The center is wound with the threads by placing the center on a drive belt and having a support roller apply a force to maintain the center against the drive belt. As the drive belt is turned, the center is spun. Preferably, at least two threads are fed from at least one feed spool through a tension controller. The stretched threads are then fed together onto the spinning center. When the wound ball reaches the desired diameter, a sensor attached to the support roller will recognize the size and stop the drive belt from rotating thereby stopping the threads from being wound onto the center. The threads are then cut and tied, allowing the wound center to be removed from the drive belt. The threads can be fed to the center at different angles and tensions. Moreover, the wound layer of different threads could be "fused" together under the pressures and temperatures of molding, allowing utilization of the characteristics of all the threads.

The inner sphere, or center, of the golf ball may be of any dimension or composition, such as a thermoset solid rubber sphere, a thermoplastic solid sphere, wood, cork, metal, or any material known to one skilled in the art of golf ball manufacture. Preferably, the solid inner sphere is comprised of a resilient polymer such as polybutadiene, natural rubber, polyisoprene, styrene-butadiene, or ethylene-propylene-diene rubber. Similarly, the inner sphere could be a liquid filled sphere or shell such as a rubber sack, a thermoplastic, or metallic shell design, in which the liquid could be of any composition or viscosity. It is also feasible to construct such a center with a void or gas center. In another embodiment, the center can be filled with a liquid, a gel, a paste, a cellular foam, or a gas. Preferably, the center outer diameter is about 0.5 to 1.5 inches. Preferably, the combination of the center and the wound layer has an outer diameter of about 1.4 to 1.62 inches.

Finally, a cover is molded around the core. The cover can have one or more layers. Any process that results in accurate and repeatable central placement of the core within the cover is acceptable. Generally, covers are applied by compression molding, injection molding or casting cover material over the core.

BRIEF DESCRIPTION OF THE DRAWINGS

FIG. 3 is not properly scaled in comparison to the other Figures;

FIG. 4 is not properly scaled in comparison to the other Figures;

FIG. 5 is not scaled properly in comparison to the other Figures;

DESCRIPTION OF THE PREFERRED EMBODIMENT

The present invention is directed to a golf ball having a wound layer formed of multiple threads that were wound simultaneously. Preferably, at least two threads are wound on a center and the threads have different chemical, physical, thermal or mechanical properties. The threads used in the present invention can be of a variety of materials and cross-sections. Most preferably, the threads are wound on the center substantially different from each other, either in cross-section shape or size, composition, elongated state, physical property or mechanical property. Mechanical properties are, for example, resiliency, elastic modulus, and density. Thermal properties may include melt temperature, glass transition temperature and thermal expansion coefficient. The winding can use the same or various levels of tension and elongation in a conventional fashion. For example, initially the winding can occur at low tension then at a predetermined time or diameter the winding can occur at high tension.

Figure 1:
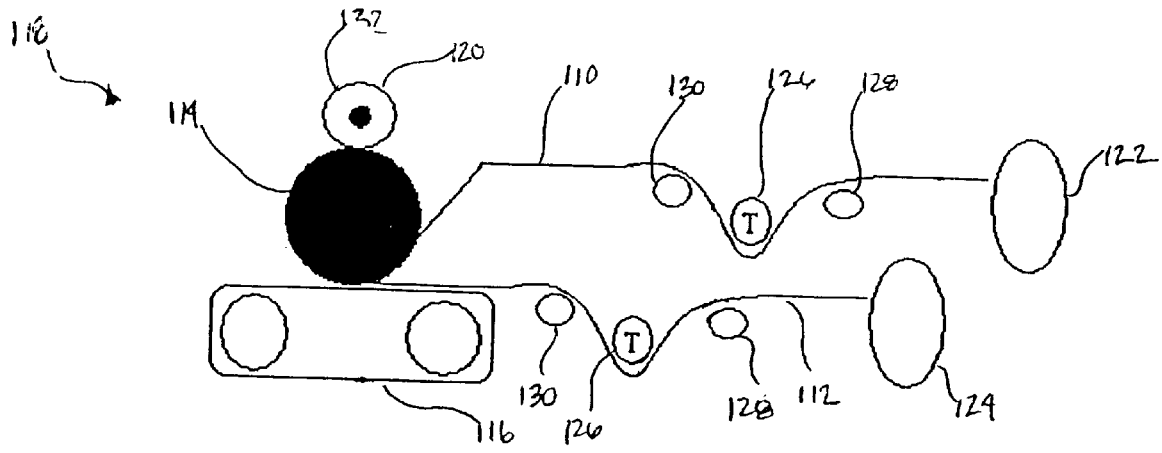
FIG. 1 is a schematic of the winding process.

Referring to FIG. 1, a diagram of the method for winding at least two threads 110 and 112, according to the present invention, onto a center 114 of a golf ball is shown. The center 114 is placed on a drive belt 116 of a winding machine 118. A support roller 120 is placed against the center 114 such that the support roller 120 applies a force against the center to maintain the center against the drive belt 116. When the drive belt is turned the center is forced to spin because the center is held against the drive belt. At least two threads are fed from thread feed spools 122 and 124 through a tension controller 126. Preferably, the tension controller is a magnetic tension control. More preferably, guide rollers 128 and 130 are located on either side of the tension controller to assist in guiding the threads to the center. Preferably, each thread is fed from its own thread feed spool 122 and 124 to the center. More preferably, each thread is fed from its own thread feed spool 122 and 124 through a guide roller 128, a magnetic tension controller 126 and through another guide roller 130 to direct the thread to the center. If more than two threads are wound, preferably each thread has their own feed spool, guide rollers and tension controllers to direct the thread to the center. The threads are stretched and fed together onto the spinning center. Thus, the wound layer is formed of multiple threads wound simultaneously on the center. When the center and windings reach the desired preselected diameter, the support roller 120 contacts a sensor 132, located above the support roller 120, stopping the drive belt 116, and consequently the center, from rotating, and stopping the threads from being fed onto the center. Preferably, this diameter is about 1.4 to 1.62 inches. The thread is then cut and tied, and the center may be removed from the drive belt.

The manufacturing process for wound cores is such that the thread 110 and 112 is preferably extended during the winding process and then remains in the elongated state permanently. During use, when the club strikes the golf ball, a small perturbation or additional extension is applied to the wound thread as a result of ball deformation. Therefore, to properly characterize elastic fiber performance, one should make measurements that emulate use conditions. This is especially true for elastic fibers, as the stress strain relationship for these materials is highly nonlinear.

Tension during winding of the present invention may be varied. This is done by starting the winding at one tension and then increasing or decreasing the tension after a predetermined time. Moreover, one or more threads can be wound under tension, while others may not be or they may be wound under different tensions. Furthermore, according to another aspect of the invention, one or more threads can be fed from various angles onto the center preferably planar and perpendicular to the spin axis and at angle relative to each other. If one thread is fed at an angle, preferably it is fed at an angle of at least 20 degrees, and more preferably at an angle of at least 30 degrees. The tensions and angles for winding the threads are selected to provide desirable ball properties.

Furthermore, "stepping" may be used, where during molding of the wound cores the temperature and pressure are stepped from an initial temperature and pressure either to a higher or lower temperature or pressure. For example, an initial temperature of 120° F. may be stepped up to 350° F. after a desired period of time.

The threads 110 and 112 of the present invention have varying properties in order that physical benefits of each thread is utilized. Threads such as polyisoprene, polyether urea, polyester, polyethylene, polypropylene may be used with the present invention. Relatively high and low modulus threads may be wound simultaneously around a center. Further, threads having different thicknesses or elongation could be used. Moreover, in another embodiment a thread that "softens" during the compression and/or injection molding cycles, creating a "mantle" layer, such as polyether urea, could be combined with a thread that does not exhibit softening during molding such as polyisoprene. This wound layer could be "fused" together under temperatures and pressures of molding. Thus, the golf ball utilizes the characteristics of all the threads.

Threads used in the present invention may be formed using a variety of processes including conventional calendering and slitting. Furthermore, processes such as melt spinning, wet spinning, dry spinning and polymerization spinning may also be used to provide threads. Melt spinning is a highly economic process. Polymers are extruded through spinnerets by a heated spin pump. The resulting fibers are drawn off at rates up to 1200 m/min. The fibers are drawn and allowed to solidify and cool in the air. Because of the high temperatures required, only melting and thermally stable polymers can be melt spun. These polymers include poly(olefins), aliphatic polyamides, and aromatic polyesters.

For polymers that decompose on melting, the wet spinning method is used. Solutions of about 5 to 20% are passed through the spinnerets by a spin pump. A precipitation bath is used to coagulate the filaments and a drawing or stretching bath is used to draw the filaments. Filament production rates under this method are lower than melt spinning, typically about 50–100 m/min. Because of solvent recovery costs, this method is less economical.

In dry spinning, air is the coagulating bath. The method is usable for polymers that decompose on melting, however only when readily volatile solvents are known for the polymers. Solutions of about 20 to 55% are used. After leaving spinneret orifices, resulting filaments enter a chamber having a length of about 5 to 8 m. In the chamber, jets of warm air are directed toward the filaments. This causes the solvent to evaporate and the filaments to solidify. The process has higher rates of spinning than the wet spinning process. Typically, filament production rates are about 300 to 500 m/min. The initial capital investment of equipment is higher, but the operation costs are lower than in wet spinning. Further, this process is only usable for spinning polymers for which readily volatile solvents are known.

In another method of spinning, polymerization spinning, a monomer is polymerized together with initiators, fillers, pigments, and flame retardants, or other selected additives. The polymerizate is directly spun at rates of about 400 m/min. The polymerizate is not isolated. Only rapidly polymerizing monomers are suitable for this method. For example, LYCRA® is produced by polymerization spinning.

Figure 2:
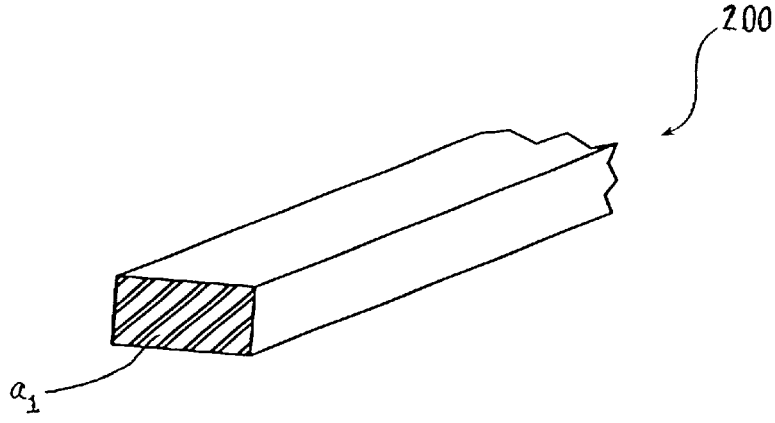
FIG. 2 is an enlarged, partial perspective view of a conventional single-ply thread for use in a golf ball of the present invention.

Many different kinds of threads are usable with the present invention. For example, referring to FIG. 2, a conventional single-ply golf ball thread 200 is shown. In general, the single-ply golf ball thread 200 is formed by mixing synthetic cis, polyisoprene rubbers, natural rubber and a curing system together, calendering this mixture into a sheet, curing the sheet, and slitting the sheet into threads. The typical area of the thread 200 is $a_1$, which is generally about 0.0013 $in^2$.

Figure 3:
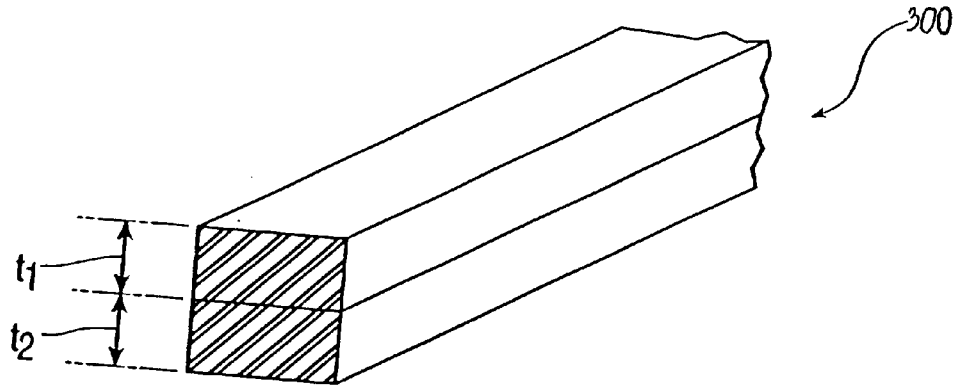
FIG. 3 is an enlarged, partial perspective view of a conventional two-ply thread for use in a golf ball of the present invention.

Referring to FIG. 3, a conventional two-ply golf ball thread 300 is shown that is also usable with the present invention. In the case of the two-ply golf ball thread, the mixture and calendering steps are the same as on the single-ply thread. However, after the sheets are thus formed, they are calendered together, cured to bond the plies or sheets together and slit into threads. Each ply of the thread 300 has a thickness, $t_1$, and $t_2$, respectively. Generally, these thicknesses are substantially the same and each ply also has the same physical properties.

Figure 4:
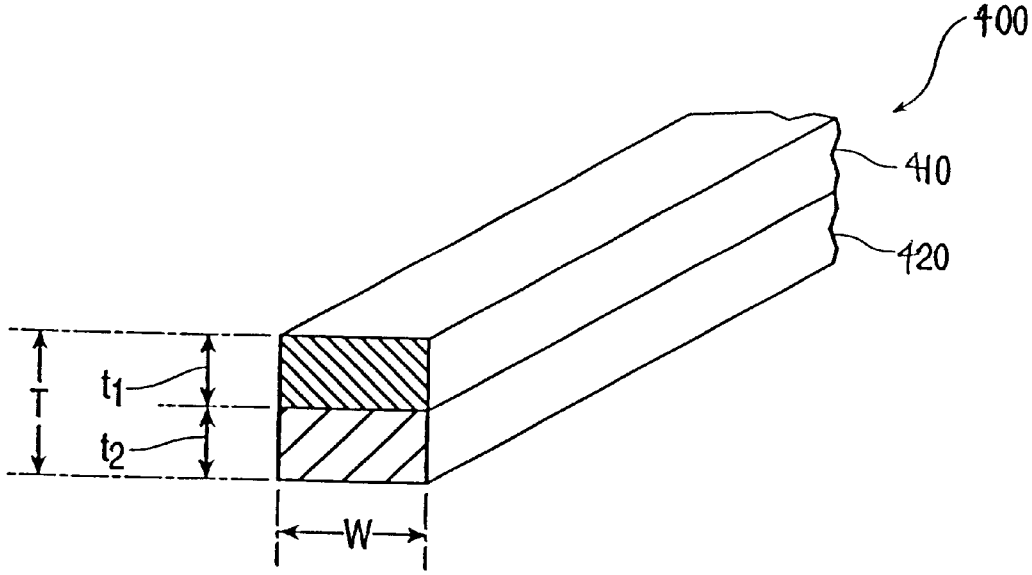
FIG. 4 is an enlarged, partial perspective view of another two-ply thread for use in the golf ball of the present invention.

As shown in FIG. 4, another two-ply thread, usable with the present invention, is formed by the conventional techniques of mixing the thread materials, calendering the thread materials into sheets of the two plies, calendering the sheets or plies together, connecting the plies together, and slitting the sheets into two threads 400. The step of connecting the plies together can be by vulcanizing the material while the two plies are held together under pressure, which will bond the plies together. The vulcanization system is a sulfur bearing system that is activated by heat and known by those of ordinary skill in the art. Preferably, the first ply 410 is more resilient and the second ply 420 is more processable, as evidenced by the physical properties of each ply.

Figure 5:
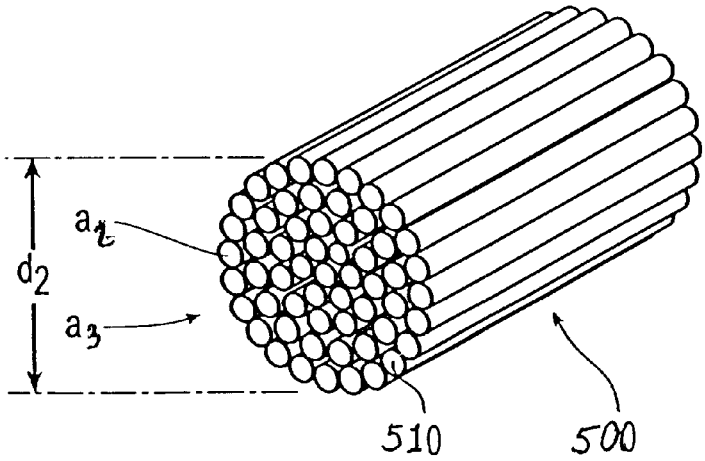
FIG. 5 is an enlarged, partial perspective view of a thread for use in the golf ball of the present invention.

Another type of thread usable in the present invention is shown in FIG. 5. Thread 500 is comprised of many individual filaments or strands 510. Preferably over 10 strands 510 make up the thread 500, and more preferably over 50 strands 510 form the thread 500. Most preferably, the thread contains greater than 100 strands. The strands 510 have a small diameter, typically of a diameter of less than about 0.01 inches, and more preferably less than about 0.002 inches. Preferably, the strands of the present invention have a cross-sectional area $a_2$ of less than about 0.0001 $in^2$ and most preferably less than about 0.00001 $in^2$. Preferably, the thread of the present invention has a cross-sectional area $a_3$ of less than about 0.001 $in^2$ and most preferably less than about 0.0005 $in^2$.

Preferably, the thread has an elongation to break of greater than about 8%. More preferably, the thread has an elongation to break of greater than about 25%. A minimum of about 8% thread elongation prior to breakage allows the golf ball to deform during impact. A golf ball where the thread deforms significantly less than about 8% during a typical driver impact will feel hard when struck and will have undesirable spin and feel characteristics. Preferably, the elastic modulus of the thread in the wound state is greater than about 25,000 psi. More preferably, the elastic modulus is greater than 10,000 psi.

The strands 510 of the thread 500 of FIG. 5 may be held together with a binder as shown or they may be spun together. Melt spinning, wet spinning, dry spinning, and polymerization spinning may be used to produce the threads. Each method was discussed in more detail previously.

The thread 500 of FIG. 5 is preferably comprised of a polymeric material. Suitable polymers include polyether urea, such as LYCRA®, polyester urea, polyester block copolymers such as HYTREL®, isotactic-poly(propylene), polyethylene, polyamide, poly(oxymethylene), polyketone, poly(ethylene terephthalate) such as DACRON®, poly(p-phenylene terephthalamide) such as KEVLAR®, poly (acrylonitrile) such as ORLON®, trans, trans-diaminodicyclohexylmethane and dodecanedicarboxylic acid such as QUINA®. LYCRA®, HYTREL®, DACRON®, KEVLAR®, ORLON®, and QUINA® are available from E. I. DuPont de Nemours & Co. of Wilmington, Del. Glass fiber and, for example, S-GLASS® from Corning Corporation can also be used.

Alternatively, the threads 500 according to FIG. 5 made from natural fibers are contemplated for use in the present invention. More particularly, mineral fibers such as silicates, vegetable fibers such as cellulosic and animal fibers are contemplated. More particularly, the vegetable fibers can be broken into four groups: bast fibers, leaf fibers, seed-hair fibers and palm fibers. Bast fibers include those made from the bark or stems of certain plants, leaf fibers include those made from cordage, seed-hair fibers comprise cotton and kapok and palm fibers originate from other parts of plants.

The thread 500 may also be comprised of strands 510 having different physical properties to achieve desired stretch and elongation characteristics. For example, the thread may be comprised of strands of a first elastic type of material that is weak but resilient and also strands of a second elastic type of material that is stronger but less resilient. In another example, the thread may be comprised of at least one strand of polyisoprene rubber thread having a diameter of less than about 0.006 inches. This strand may be surrounded by about 10–50 polyetherurea strands having diameters of less than about 0.002 inches.

The elastic modulus is measured by clamping the elastic fibers in a test apparatus equipped with a load cell and extension meter such as those available from MTS Systems Corporation in Eden Prairie, Minn. The fibers are elongated to an extension comparable to the extension associated with the core winding process and the cross-sectional area $A_{bl}$ and load $P_{bl}$ are measured. Then an additional 5% elongation is applied to the fiber, which load $P_{5\%}$ is measured. The modulus, E, may then be computed as:

$$E = \frac{P_{5\%} - P_{bl}}{(A_{bl})(.05)}$$

For example, in the case of polyisoprene thread, extensions between 500 and 1000% are typical. When spun LYCRA® thread is used, winding elongations between 100 to 400% are typical.

In one embodiment, the thread 500, usable with the present invention, is formed from solvent spun polyether urea elastomer LYCRA® made by E. I. DuPont de Nemours & Co. of Wilmington, Del. This thread may be manufactured with a cross-sectional area much smaller than the isoprene threads typically used in forming the wound layer of a golf ball. Because of the thread's smaller diameter, $d_2$, it may be used to form golf balls and cores with greater packing density and superior properties. Also, the elastic modulus of the solvent spun polyetherurea thread is greater than about 10,000 psi when elongated. Specifically, the elastic modulus is between about 30,000 and 50,000 psi when elongated between about 200 and 400%. Elongation yielding optimal resilience of the thread is between about 200 and 500%.

In another embodiment of the present invention, there are a plurality of wound layers, at least one of which is separated by 1 or more dipped layers, such as those disclosed in U.S. Pat. No. 6,030,296, which is incorporated herein by reference.

Figure 6:
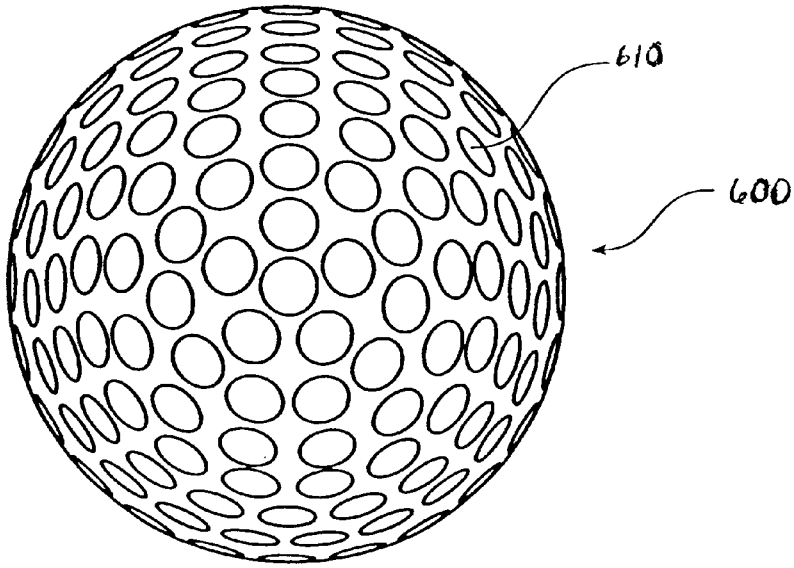
FIG. 6 is an elevational view of a golf ball according to the present invention.
Figure 7:
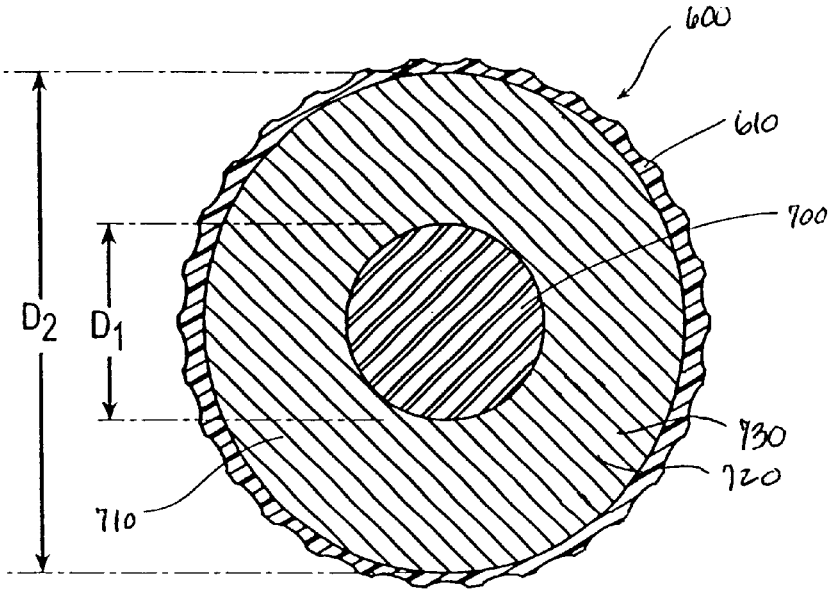
FIG. 7 is a cross-sectional view of a golf ball having two wound threads according to the present invention.
Figure 8:
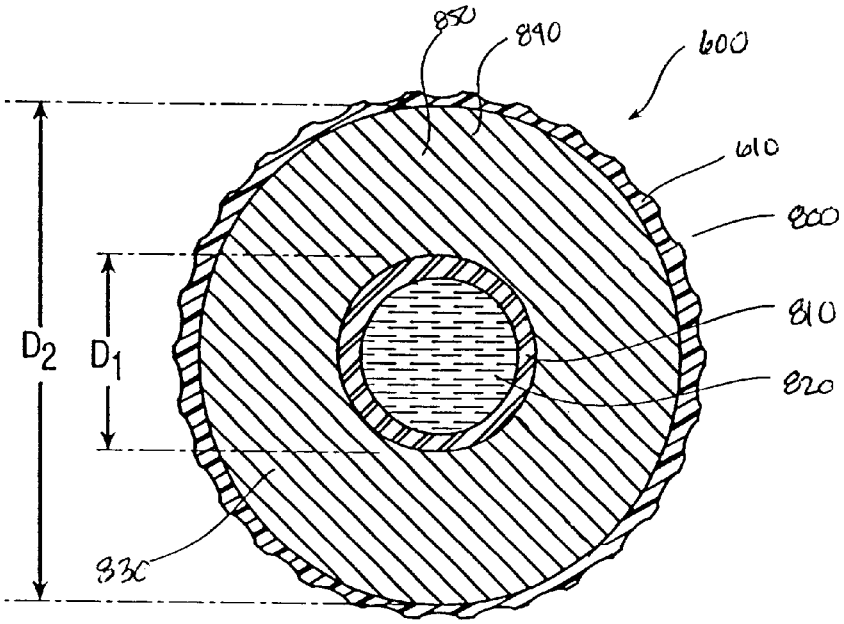
FIG. 8 is a cross-sectional view of a golf ball having two wound threads according to the present invention.

A golf ball 600 according to the present invention is shown in FIG. 6. The golf ball 600 features a cover 610. The golf ball 600 may be formed as shown in FIGS. 7–10. As shown in FIGS. 7–10, the thread is wound about the center to form the wound layer. The center of the present invention may be of any dimension or composition. As shown in FIG. 7, the center 700 of golf ball 600 is solid. The center 700 could be a thermoset solid rubber sphere, a thermoplastic solid sphere, wood, cork, metal, or any material known to one skilled in the art of ball manufacture. The center is covered with a wound layer 710, according to the present invention, and a cover 610. Similarly, as shown in FIG. 8, the center 800 could be a liquid-filled sphere or shell 810 such as a rubber sack, a thermoplastic, or metallic shell design. The liquid 820 employed could be of any composition or viscosity. It is also feasible to construct such a center 800 with a void (hollow) or "gas" center. The wound golf ball 600 comprises a fluid-filled center 800, at least one cover layer 610 and at least one wound layer 830 disposed there between. The wound layer 830 is formed according to the present invention.

A representative base composition for forming a solid golf ball center 700, which is comprised of at least one layer as shown in FIG. 7, comprises polybutadiene and, in parts by weight based on 100 parts polybutadiene, about 0 to about 50 parts of a metal salt diacrylate, dimethacrylate, or monomethacrylate, preferably zinc diacrylate, and about 0.01 to about 2 parts peroxide such as dicumyl peroxide. Commercial sources of polybutadiene include CARIFLEX® 1220 manufactured by Shell Chemical, NEOCIS® BR40 manufactured by Enichem Elastomers, and UBEPOL® BR150 manufactured by Ube Industries, Ltd. If desired, the polybutadiene can also be mixed with other elastomers known in the art, such as natural rubber, styrene butadiene, and/or polyisoprene in order to further modify the properties of the center 700. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity. The zinc diacrylate can be of various grades of purity. For the purposes of this invention, the lower the quantity of zinc stearate present in the zinc diacrylate the higher the zinc diacrylate purity. Zinc diacrylate containing less than about 10% zinc stearate is preferable. More preferable is zinc diacrylate containing about 4–8% zinc stearate. Suitable, commercially available zinc diacrylates includes those from the Sartomer Corporation. A typical golf ball core incorporates 1 pph to 50 pph of zinc oxide in a zinc diacrylate-peroxide cure system that cross-links polybutadiene during the core molding process. The preferred concentrations of zinc diacrylate that can be used are about 0 to about 50 pph and preferably about 10 to about 30 pph based upon 100 pph of polybutadiene or alternately, polybutadiene with a mixture of other elastomers that equal 100 pph.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di(t-butylperoxy)3,3,5-trimethyl cyclohexane, a-a bis(t-butylperoxy)diisopropylbenzene, 2,5-dimethyl-2,5 di(t-butylperoxy)hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 pph and 2.5 pph based upon 100 parts of butadiene, or butadiene mixed with one or more other elastomers. More preferably, the amount of initiator added ranges between about 0.15 pph and 2 pph and most preferably between about 0.25 pph and 1.5 pph.

The compositions of the present invention may also include fillers, added to the elastomeric composition to adjust the density and/or specific gravity of the core. As used herein, the term "fillers" includes any compound or composition that can be used to vary the density and other properties of the subject golf ball core. Fillers useful in the golf ball core according to the present invention include, for example, zinc oxide, barium sulfate, and regrind (which is recycled core material ground to about 30 mesh particle size). The amount and type of filler utilized is governed by the amount and weight of other ingredients in the composition, since a maximum golf ball weight of 1.620 ounces has been established by the USGA. Appropriate fillers generally used range in specific gravity from about 2.0 to 5.6.

Antioxidants may also be included in the elastomer centers produced according to the present invention. Antioxidants are compounds which prevent the oxidative degradation of the elastomer. Antioxidants useful in the present invention include, but are not limited to, quinoline type antioxidants, amine type antioxidants, and phenolic type antioxidants.

Other ingredients such as accelerators, e.g., tetramethylthiuram, peptizers, processing aids, processing oils, plasticizers, dyes and pigments, as well as other additives well known to the skilled artisan may also be used in the present invention in amounts sufficient to achieve the purpose for which they are typically used.

A cis-trans conversion catalyst may also be included in the present invention. The catalyst may be an organosulfur or metal-containing organosulfur compound, a substituted or unsubtituted aromatic organic compound that does not contain sulfur or metal, an inorganic sulfide compound, an aromatic organometallic compound, or mixtures thereof. A "cis-to-trans catalyst" herein, means any compound or a combination thereof that will convert at least a portion of cis-polybutadiene isomer to trans-polybutadiene isomer at a given temperature.

The envelope or shell 810 of FIG. 8 can be filled with a wide variety of materials for fluid 820 including air, gas, water solutions, gels, foams, hot-melts, other fluid materials and combinations thereof as set forth in U.S. Pat. No. 5,683,312, which is incorporated herein by reference. The fluid or liquid in the center can be varied to modify the performance parameters of the ball, such as the moment of inertia, weight, initial spin, and spin decay.

Suitable gases include air, nitrogen and argon. Preferably, the gas is inert. Examples of suitable liquids include either solutions such as salt in water, corn syrup, salt in water and corn syrup, glycol and water or oils. The liquid can further include water soluble or dispersable organic compounds, pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which at or about normal room temperatures are solid but at elevated temperatures become liquid.

The fluid can also be a reactive liquid system which combines to form a solid or create internal pressure within the envelope. Examples of suitable reactive liquids that form solids are silicate gels, agar gels, peroxide cured polyester resins, two part epoxy resin systems and peroxide cured liquid polybutadiene rubber compositions. Of particular interest are liquids that react to form expanding foams. It is understood by one skilled in the art that other reactive liquid systems can likewise be utilized depending on the physical properties of the envelope and the physical properties desired in the resulting finished golf balls.

Preferably, the center 700 and 800 of FIGS. 7 and 8 has an outer diameter $D_1$ of about 0.5 to 1.5 inches. Preferably, the wound layer 710, 830 has an outer diameter $D_2$ of about 1.4 to 1.62 inches. The center 700, 800 maybe larger than a typical center to improve alterable characteristics such as spin and compression.

The golf balls 600 of FIGS. 6–10 may be made by any conventional process employed in the golf ball art. For example, the golf ball 600 of FIG. 7 is manufactured by injection or compression molding the solid center 700. The threads 720 and 730 are then wound about the solid center 700 to form the wound layer 710 as previously described. Threads with different characteristics, as previously described, including elongations, physical properties, compositions, or cross-sections are used depending on the desired results for ball performance. The cover layer or layers 610 is then injection or compression molded or cast about the wound layer 710 which processes are well known in the art.

Figure 9:
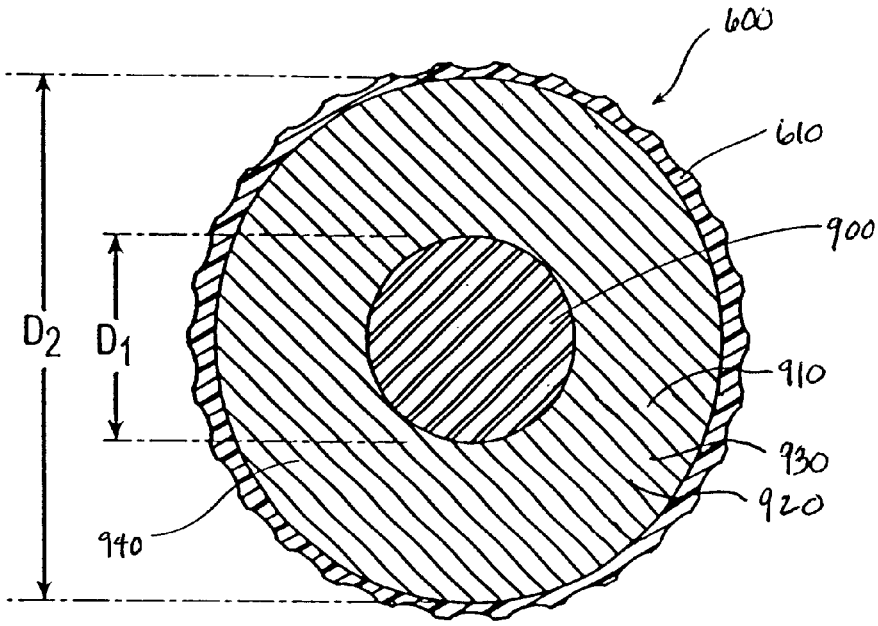
FIG. 9 is a cross-sectional view of a golf ball having three wound threads according to the present invention.

Turning to FIG. 8, a golf ball 600 of the present invention can be formed by initially forming the shell 810 by compression molding hemispherical cups, the cups are bonded together to form the shell 810 to create a cavity and filling the cavity with fluid or liquid 820 to form the fluid filled center 800. The threads 840 and 850 are then wound around the shell 810 to form the wound layer 830 as previously described. Threads with different characteristics, as previously described, including elongations, physical properties, compositions, or cross-sections are used depending on the desired results for ball performance. Different elongations or angles are used depending on the desired results for ball performance. The cover 610 is then injection or compression molded or cast about the wound layer 830. The golf ball 600 of FIG. 9, is formed as either FIG. 7 or 8, with either a solid liquid center 900, except that at least three different kinds of threads 910, 920 and 930 are wound about the center 900 to form wound layer 940. A cover 610 is formed over the wound layer 940.

Figure 10:
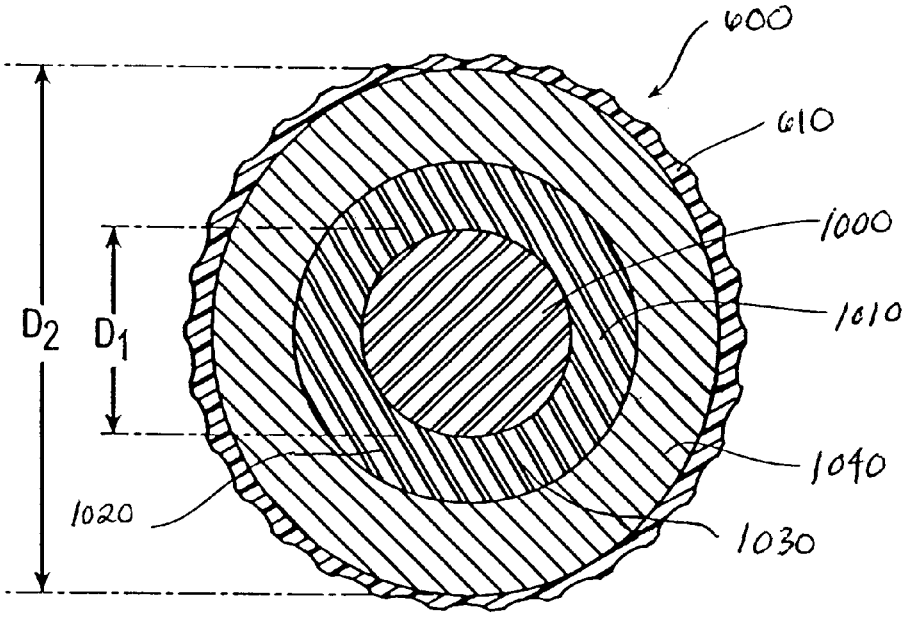
FIG. 10 is a cross-sectional view of a golf ball according to the present invention having an additional layer.

Referring to FIG. 10, the golf ball 600 may have a solid or liquid filled center 1000 formed as described above. An additional layer or layers may be formed over the center 1000. For example, as shown, a first wound layer 1010 is formed over the center 1000. The wound layer 1010 is formed of at least two threads 1020 and 1030 wound simultaneously according to the present invention. A conventional second wound layer 1040 is formed over the first wound layer 1010. A cover 610 is formed over the second wound layer 1040. The cover 610 may be formed as previously described. Moreover, there are many variations of FIG. 10, including forming the conventional layer of winding immediately adjacent the center, with the wound layer, according to the present invention, formed over the conventional wound layer. Furthermore, it is conceivable that instead of two wound layers, a solid layer or layers could be formed either between the center and the wound layer according to the present invention, or between the wound layer according to the present invention and the cover. Numerous materials, as previously described could be used to form these additional layers.

Referring to FIGS. 7–10, the cover 610, provides the interface between the ball 600 and a club. Properties that are desirable for the cover 610 are good moldability, high abrasion resistance, high tear strength, high resilience, and good mold release, among others. In accordance with the preferred balls, the cover has a thickness to generally provide sufficient strength, good performance characteristics and durability. Preferably, the cover is of a thickness from about 0.03 inches to about 0.12 inches. More preferably, the cover is about 0.04 to 0.09 inches in thickness and, most preferably, is about 0.05 to 0.085 inches in thickness. The cover can be formed of materials, such as balata, ionomers, metallocene-catalyzed polymers, polyurethanes, or a mixture thereof. The cover can have two layers where the first layer surrounds the core and the second layer surrounds the first layer.

The cover 610 of the golf ball can be comprised of one or more layers and is generally made of polymeric materials such as ionic copolymers of ethylene and an unsaturated monocarboxylic acid which are available under the trademark SURLYN® of E. I. DuPont de Nemours & Co. of Wilmington, Del. or IOTEK® or ESCOR® from Exxon. These are copolymers or terpolymers of ethylene and methacrylic acid or acrylic acid partially neutralized with zinc, sodium, lithium, magnesium, potassium, calcium, manganese, nickel or the like.

In another embodiment, the cover 610 can be formed from mixtures or blends of zinc, lithium and/or sodium ionic copolymers or terpolymers.

Also, SURLYN® resins for use in the cover are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The invention can likewise be used in conjunction with covers having homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U.S. Pat. No. 5,334,673.

(4) Polyureas such as those disclosed in U.S. Pat. No. 5,484,870.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as PEBAX® sold by ELF-Atochem.

(8) Polyphenylene oxide resins, or blends of polyphenylene oxide with high impact polystyrene as sold under the trademark NORYL® by General Electric Company, Pittsfield, Mass.

(9) Thermoplastic polyesters, such as polyethylene terephthalate, polybutylene terephthalate, polyethylene terephthalate/glycol modified and elastomers sold under the trademarks HYTREL® by E. I. DuPont de Nemours & Co. of Wilmington, Del. and LOMOD® by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover 610 is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers and blends thereof. Still further, the cover is preferably comprised of a polyether or polyester thermoplastic urethane, a thermoset polyurethane, an ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent. More preferably, in a low spin rate embodiment designed for maximum distance, the acrylic or methacrylic acid is present in 15 to 35 weight percent, making the ionomer a high modulus ionomer. In a high spin embodiment, the cover includes an ionomer where an acid is present in 10 to 15 weight percent and includes a softening comonomer.

The covers of the present invention may also comprise a castable reactive material, such as polyurethane. U.S. Pat. Nos. 5,334,673, 5,692,974, and 5,733,428, which are incorporated herein by reference, disclose golf ball covers comprising various thermosetting polyurethanes and blends thereof.

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims.

EXAMPLE 1

In one embodiment, two threads were simultaneously wound about a solid center. The center had a diameter of 1.45 inches, a compression of about 71.1 and weighed about 1.154 ounces. The threads were LYCRA® XA 1460 DTX and LYCRA® 902C 1160 DTX thread, both made by E. I. DuPont de Nemours & Co. They were each wound simultaneously about the center, as previously described, at elongations of about 300%. The wound core was then covered with Na/Li compression molded covers having a Shore D hardness of 69. The completed golf ball had a diameter of about 1.682 inches, weighed about 1.62 ounces, and had a Coefficient of Restitution of 0.790.

EXAMPLE 2

In another embodiment, a polyether urea thread is wound onto a center of a golf ball along with a polyisoprene thread. The center has a diameter of about 1.45 inches. The two threads are wound on the center simultaneously, as previously described at elongations of about 400% for the polyether urea thread and 800% for the polyisoprene thread. A cover is compression molded over the wound core with Na/Li having a shore D hardness of 69. The diameter of the completed ball is 1.682 inches.

EXAMPLE 3

In another embodiment, a S Glass thread is wound onto a center of a golf ball along with a nylon thread. The center has a diameter of about 1.45 inches. The two threads are wound on the center simultaneously, as previously described at elongations of about 1% for the S Glass thread and 30% for the nylon thread. A cover is compression molded over the wound core with a Na/Li ionomer having a shore D hardness of 69. The diameter of the completed ball is 1.682 inches.

The term "about," as used herein in connection with one or more numbers or numerical ranges, should be understood to refer to all such numbers, including all numbers in a range.

While it is apparent that the illustrative embodiments of the invention herein disclosed fulfills the objectives stated above, it will be appreciated that numerous modifications and other embodiments may be devised by those skilled in the art. For example, the present invention could use at least three threads where two or more of the threads may be the same, while the third or other threads are chemically, physically or mechanically distinct from the two threads that are the same. Moreover, the golf ball may be formed with additional layers. For example, a wound layer of the present invention may be formed over a conventional wound layer formed over a center, or a conventional wound layer may be wound over a wound layer of the present invention. Therefore, it will be understood that the appended claims are intended to cover all such modifications and embodiments which come within the spirit and scope of the present invention.

What is claimed is:

1. A golf ball comprising:

a core having:

a center having a diameter of at least about 0.5 inches;

at least two threads wound simultaneously about the center, and the threads having different characteristics, wherein at least one of the threads comprises a plurality of melt, wet, dry, or polymerization spun filaments; and a cover.

2. The golf ball of claim 1 wherein the different characteristics are selected from the group consisting of chemical, physical, thermal or mechanical properties.

3. The golf ball of claim 1 wherein the threads have different cross-sections.

4. The golf ball of claim 1, wherein at least one of the threads is polymeric.

5. The golf ball of claim 4 wherein at least one of the threads is a polyether urea.

6. The golf ball of claim 1, wherein the maximum elongation of at least one of the threads is greater than about 8%.

7. The golf ball of claim 1 wherein at least one of the threads is wound at elongations of at least about 200%.

8. The golf ball of claim 1 wherein at least one of the threads has an elastic modulus in the wound state of at least about 20 ksi.

9. The golf ball of claim 1 wherein the diameter of the center is between about 0.5 and 1.5 inches.

10. The golf ball of claim 1 wherein the center is solid.

11. The golf ball of claim 1 wherein the center is fluid-filled.

12. The golf ball of claim 1 wherein the core includes at least three threads having different characteristics wound simultaneously about the center.

13. The golf ball of claim 1 wherein at least one thread comprises at least 10 individual strands.

14. The golf ball of claim 13 wherein at least one strand has a diameter of less than about 0.01 inch.

15. The golf ball of claim 1 wherein the threads have different chemical compositions.

16. The golf ball of claim 1 wherein at least one of the threads is a conventional single-ply thread.

17. The golf ball of claim 1 wherein the cover layer is formed over the wound layer.

18. The golf ball of claim 1 wherein at least one of the threads is a two-ply thread.

19. The golf ball of claim 18 wherein the two-ply thread comprises two plies each ply having different characteristics.

20. The golf ball of claim 1 wherein at least one of the threads is polyisoprene.

21. The golf ball of claim 1 wherein a first thread is polyisoprene and a second thread is polyether urea.

22. The golf ball of claim 1 wherein at least one thread has glass fibers.

23. The golf ball of claim 1, wherein the cover comprises one or more layers comprising a blend of at least one of a copolymer or terpolymer of ethylene and methacrylic acid or acrylic acid, partially neutralized with zinc, sodium, lithium, magnesium, potassium, calcium, manganese, nickel, or mixtures thereof.

24. The golf ball of claim 23, wherein the cover comprises acrylic or methacrylic acid present in an amount from about 15 to 35 weight percent.

25. The golf ball of claim 23, wherein the cover comprises acrylic or methacrylic acid present in an amount from about 10 to 15 weight percent and further includes a softening comonomer.

26. The golf ball of claim 23, wherein the blend comprises a sodium and lithium ionomer having a shore D hardness of about 69.

27. The golf ball of claim 1, wherein the cover comprises a castable reactive material.

28. The golf ball of claim 1, wherein the plurality of spun filaments comprises at least a first filament and a second filament having different physical properties.

29. The golf ball of claim 28, wherein the first filament comprises a polyisoprene rubber, and wherein the second filament comprises a polyetherurca.

30. The golf ball of claim 1, wherein the plurality of spun filaments comprise natural fibers.

31. The golf ball of claim 28, wherein the first filament is thermoplastic.

* * * * *